United States Patent [19]

Stevanovich

[11] 4,151,625

[45] May 1, 1979

[54] HOSE BRUSHING MACHINE

[75] Inventor: Srbo M. Stevanovich, Akron, Ohio

[73] Assignee: The B. F. Goodrich Company, Akron, Ohio

[21] Appl. No.: 828,681

[22] Filed: Aug. 29, 1977

[51] Int. Cl.[2] ..... A46B 13/02

[52] U.S. Cl. ..... 15/40; 15/88

[58] Field of Search ..... 15/88, 40, 104.04; 51/23, 80 R; 134/9

[56] References Cited

U.S. PATENT DOCUMENTS

| | | | |
|---|---|---|---|
| 1,676,825 | 7/1928 | Haase | 15/88 X |
| 2,359,568 | 10/1944 | Logan | 15/88 X |
| 3,641,608 | 2/1972 | Kratt | 15/88 |
| 3,797,060 | 3/1974 | Salukvadze | 15/88 |

*Primary Examiner*—Edward L. Roberts

*Attorney, Agent, or Firm*—Joseph Januszkiewicz

[57] ABSTRACT

An apparatus for brushing hose, having a cleaning head with a plurality of circumferentially spaced brushes adjustable about the pass line of a hose that is guided through the cleaning head. The brushes are rotated while the hose is moved linearly through the cleaning head. Adjusting means are provided to position the brushes radially relative to the pass line.

6 Claims, 5 Drawing Figures

FIG. 3
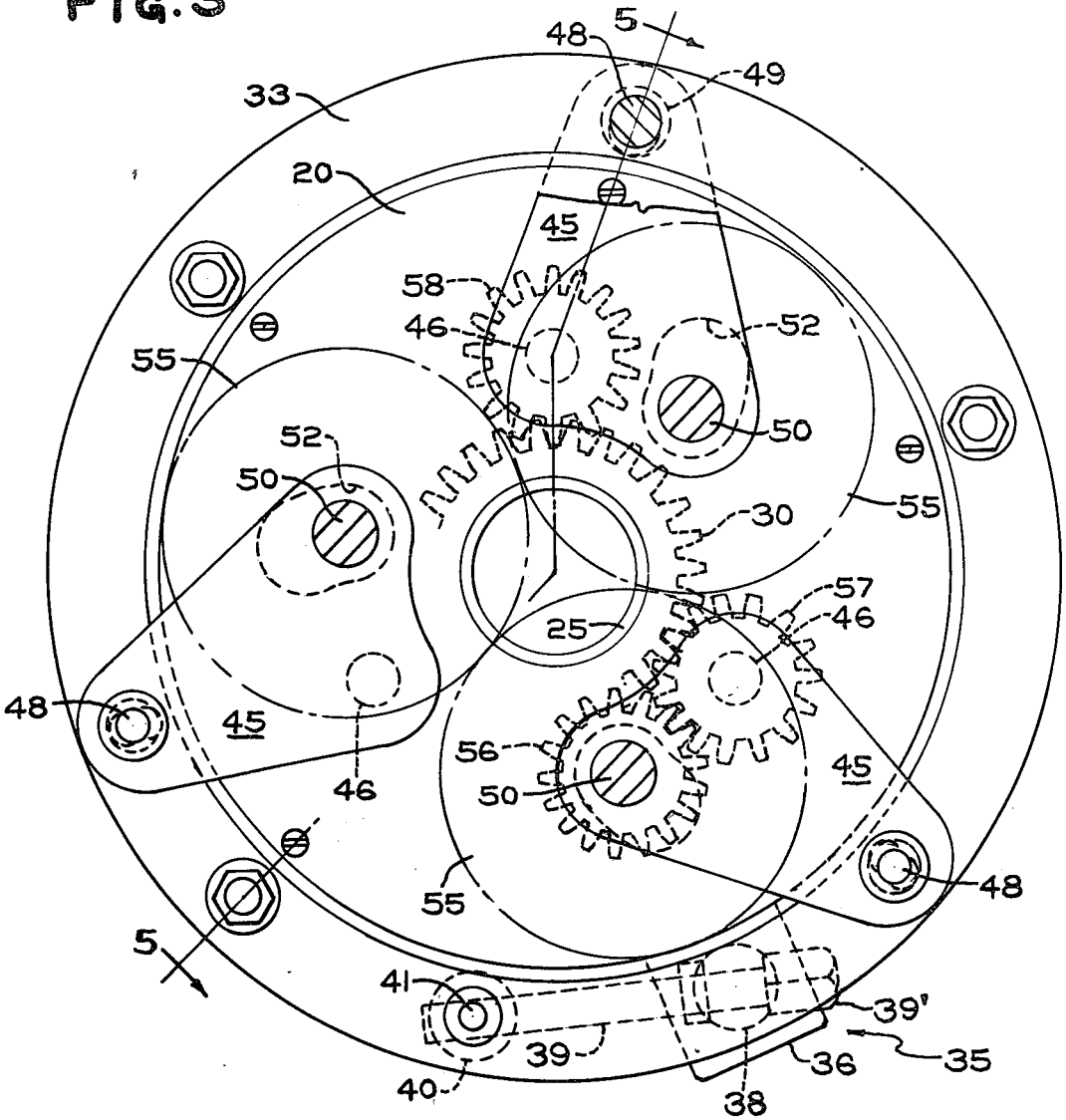
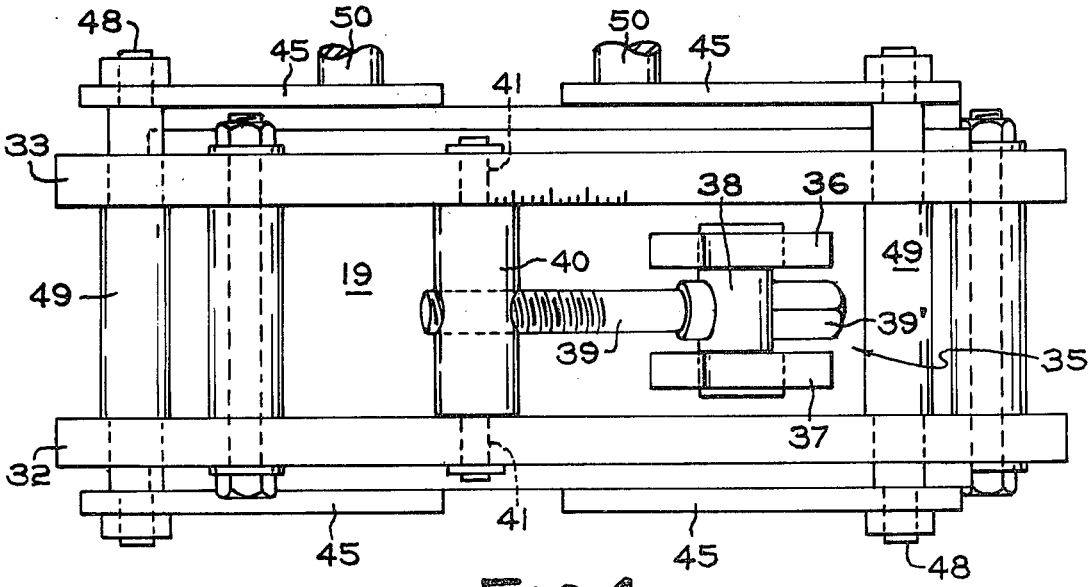
FIG. 4

HOSE BRUSHING MACHINE

BACKGROUND OF THE INVENTION

This invention relates to an apparatus for removing residue from a vulcanized hose after the final curing operation.

In the manufacture of hose having inner and outer layers of flexible polymeric material such as natural or synthetic rubber, a reinforcing section of textile fabric, fiber glass or metallic materials is woven, braided or spirally wound in a circumferentially continuous or endless manner thereabout. Thereafter such hose is vulcanized and to enhance the external appearance of the hose, it is scrubbed to remove curing media, residue or foreign particles therefrom. The hose cleaning has been substantially a hand operation or machine scrubbing in the order of a dragging action where operator assistance was necessary. The present invention provides a novel means for more economically brushing the external surface with an apparatus that is easily adjusted to different sizes or diameters and wherein the radial positions of the brushes are easily adjusted, and holds the brushes at the adjusted position and provides means to adjust to compensate for wear of the brushes.

SUMMARY OF THE INVENTION

An apparatus for brushing hose having a guide means for guiding the linear passage of hose through the apparatus. The brush cleaning head has a plurality of circumferentially spaced brushes that are rotated at high speed to brush the residue of the curing media from the exterior surface of the hose. Cam means are provided to adjust the radial position of the brushes to compensate for wear as well as to adjust for different sizes or diameters of the article.

BRIEF DESCRIPTION OF THE DRAWINGS

FIG. 3 is an enlarged fragmentary front elevational view of the brush head support assembly without the brushes.

FIG. 4 is a view of the brush head assembly showing the adjusting means.

DETAILED DESCRIPTION

Figure 2:
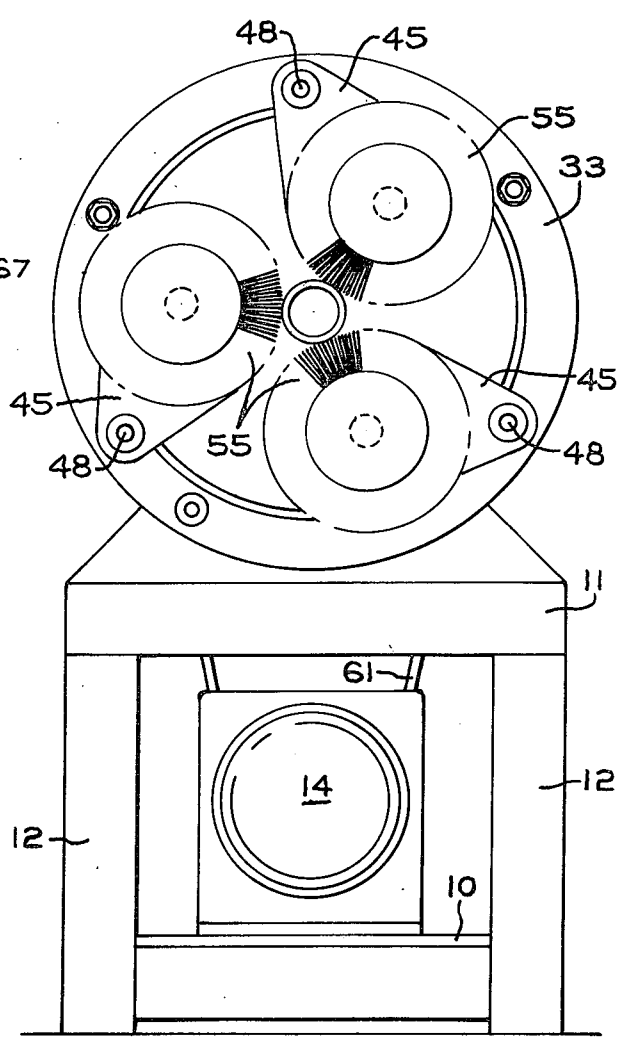
FIG. 2 is a front elevational view of the hose brushing machine.
Figure 1:
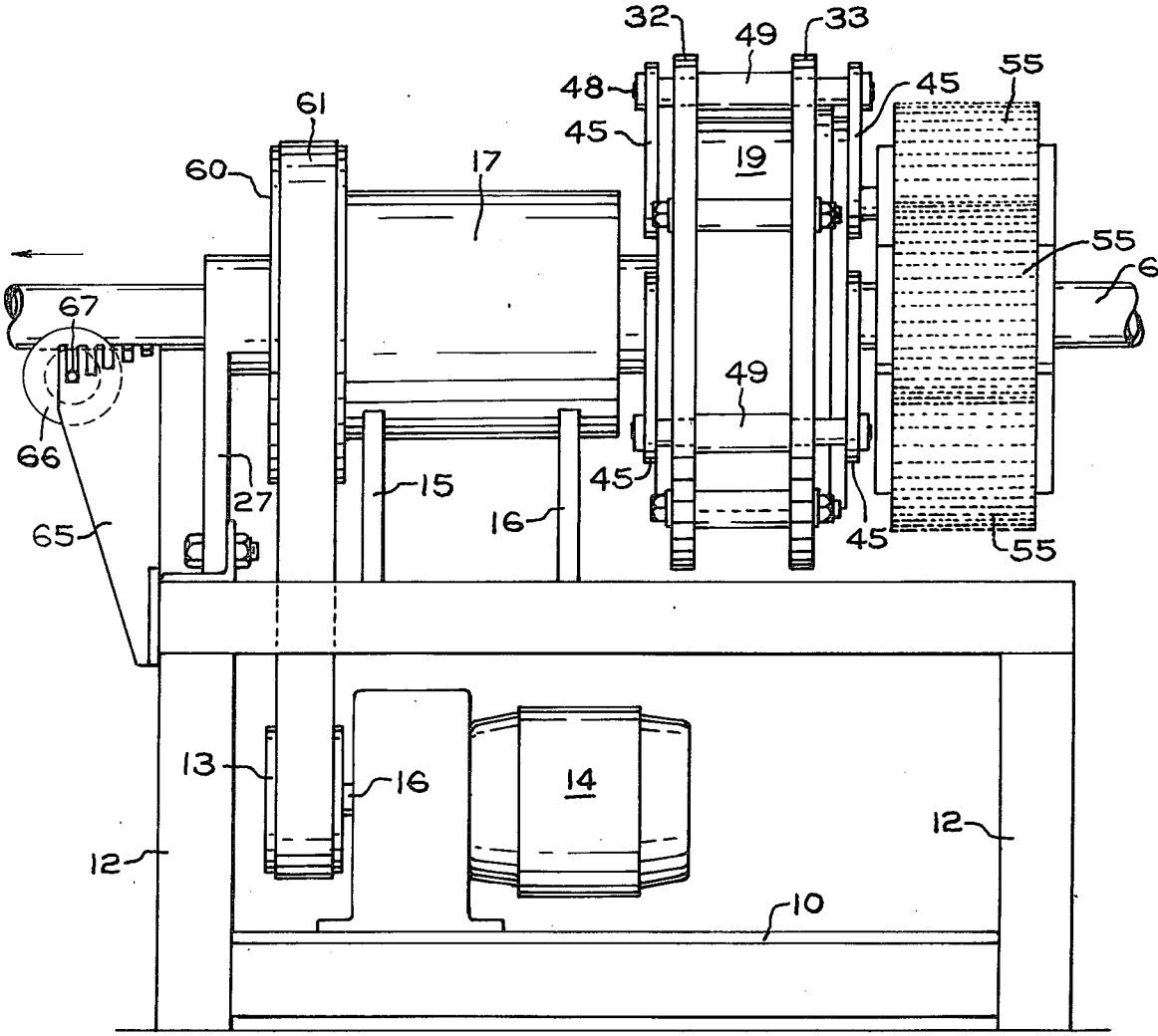
FIG. 1 is a side elevational view of the hose brushing machine.
Figure 5:
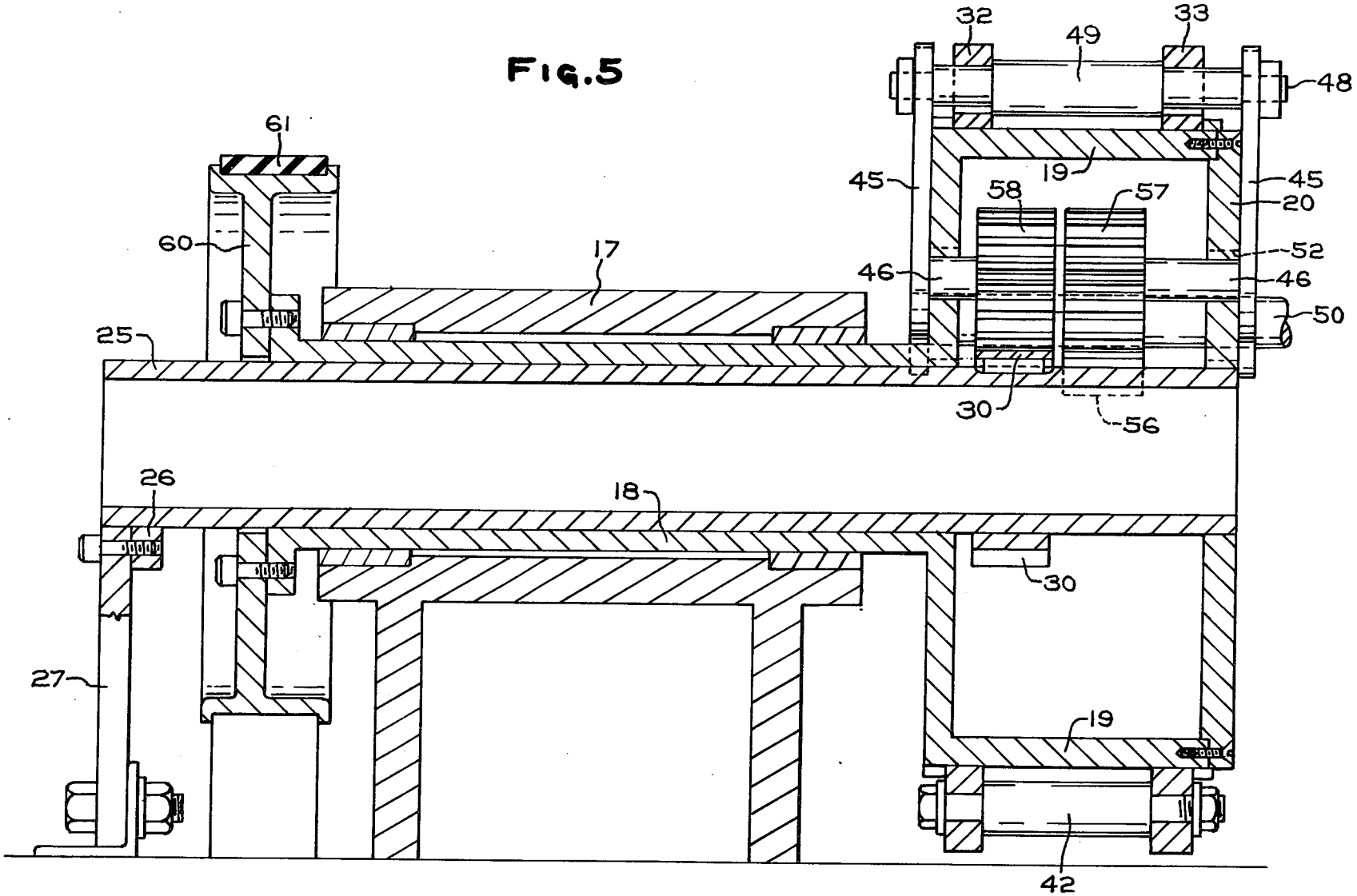
FIG. 5 is a cross-sectional side elevational view of the brush head assembly without the brushes.

Referring to the drawings, wherein like reference characters designate like or corresponding parts throughout the several views, there is shown in FIG. 1 a support means having a lower support member or base 10 and an upper support member 11. A plurality of vertically extending support members 12 interconnect the horizontally extending supports. A constant speed motor 15 is mounted on lower support member 10 having an output shaft 16 and a pulley 13.

A cylindrical shaped housing 17 is mounted on the upper support member 11 by brackets 15 and 16. Journaled for rotation in housing 17 is a longitudinally extending sleeve 18 having at one end thereof an elongated cylindrical cup shaped member or shell 19. An annular disc 20 is secured to the cylindrical shell 19 opposite the bottom portion of the shell 19 for rotation therewith to form a cage on sleeve 18. Mounted within sleeve 18 is a hollow tubular shaft or member 25 having a flanged end portion 26 that is secured via bracket 27 to the one end portion of support member 11. The other end portion of tubular member 25 has a spur gear 30 keyed or otherwise secured thereto to provide a stationary sun gear. Mounted on cage or shell 19 are a pair of circumferentially extending rings or annular ring members 32 and 33, capable of being circumferentially adjusted relative to the outer suface of shell 19. The means for adjusting the rings 32 and 33 relative to the shell 19 is an adjusting means 35 which includes a pair of bosses 36 and 37, pivotly supporting a hub 38. A threaded rod 39 has its one end formed into a square for ease of turning, with an adjacent portion rotatably journaled in hub 38 while its other end threadedly engaging an elongated nut 40. Nut 40 has a pair of axially extending portions 41 suitably secured to the respective rings 32 and 33. The square shaped end of threaded rod 39 provides means for rotating the thread relative to the stationary nut 40 to thereby move or rotate the rings 32 and 33 relative to the stationary shell 19 to provide relative rotation therebetween. A plurality of brackets 45 are pivotly mounted on shafts 46, which shafts extend through the annular disc 20 and the bottom portion of the cup shaped shell 19 for rotation therein. The brackets or bracket means 45 are mounted in aligned pairs on each side of the cage 19. The outermost end portion of each bracket 45 is secured to the rings 32 and 33 by a rod or rod member 48 and bushing 49 that extends in an axial direction relative to the longitudinal pass line of sleeve 18 to assure simultaneously movement therewith. Journaled for pivotal movement with the brackets 45 and for rotation therein is a shaft 50 that extends through an accurate slot 52 in the annular disc 20 and in the bottom portion of shell 19. The respective one end portion of each shaft 50 supports a brush 55 for rotation therewith. Each brush 55 has a plurality of radially extending bristles.

A spur gear 56 located within shell 19 is keyed to each shaft 50 for rotation therewith. Each pivot shaft 46 has keyed to it a spur gear 57 which meshes with gear 56 for rotation thereby and for rotating the respective brushes 55. In addition to spur gear 57 a spur gear 58 is also keyed to shaft 46 to be driven thereby and by the rotation of sleeve 18. Spur gear 58 is mounted closely adjacent to the bottom portion of cup shaped shell portion 19 such that it is in constant meshing engagement with the stationary gear 30 such that rotation of the shell 19 will cause rotation of spur gear 58 and 57, causing spur gear 57 to rotate gear 56 and shaft 50 as well as the corresponding brushes 55. The gears 56, 57 and 58 comprise gear means which rotates the brushes 55 about their own axes when sleeve 18 is rotated. Where threaded rod 39 of adjusting means 35 is rotated such as to rotate the rings 32 and 33 in a counterclockwise direction as viewed in FIG. 3, the respective shafts 48 carried by the rings 32 and 33 will also move in a counterclockwise direction while pivot shaft 46 remains stationary. In addition bracket 45 by this action will pivot about shaft 46 while its upper end portion moves in a counterclockwise direction as viewed in FIG. 3 and thereby pivot shaft 50 and the respective brushes 55 in a counterclockwise direction to provide a greater clearance space along the longitudinally extending pass line between the respective brushes 55. Longitudinally extending sleeve 18 as previously described has an enlarged cylindrical cup shaped shell 19 at one end thereof and a flanged pulley 60 secured to the other end thereof.

A belt 61 trained about pulleys 60 and 13 is operative to rotate the brushes 55. A bracket 65 is mounted on one end of the upper support member 11 having its upper bifurcated end portions recessed or slotted to different depths to support the respective end portions of the axles of a roller 66 which is journaled therein for rotation to support a hose 67 that is adapted to pass through the hose brushing apparatus. The brackets 45, rings 32, 33, shell 19, disc 20 and shafts 50 comprise a brush head assembly which carries the plurality of rotatable brushes 55 about their own axis as the brush head assembly is rotated. The drive means consists of motor 14, pulleys 13 and 60 along with belt 61.

In the operation of the apparatus described, the cleaning or brush head assembly is adjusted for the size of hose that is to pass therethrough by the adjusting mechanism 35. The direction of rotation of the adjusting threaded rod 39 pivots the brackets 45 of the brush head assembly which in turn pivots the brushes outwardly or inwardly about pivot shaft 46. The shaft 50 which supports the brushes 55 is arcuately moveable via slot 52 in annular disc 20 the bottom portion of cage 19. During this adjusting of the brushes, shaft 46 carries gear 58 and is constantly in mesh with sun gear 30 carried by tubular member 25; and, gear 56 which is carried by the pivotable shaft 50 is in mesh with gear 57 carried by shaft 46. Thus as the brushes 55 are pivotably adjusted about pivot shaft 46, the gears compensate for the change in the radial distance that the brushes move away from the longitudinal center line or pass line of sleeve 18. The adjustment of the radial position of the brush as described is self locking since the adjusting means is at right angles to the linear movement of the hose to be brushed as it passes linearly through the sleeve 18. Energization of motor 14 rotates sleeve 18 and the cage 19. Gear 58 which is carried by the rotating cage 19 is in mesh with stationary gear 30 thereby rotating gears 57 and 56, which in turn rotates shaft 50 and brushes 55. The speed of rotation can be governed by the constant speed motor 14 and the gear ratios.

Various modifications are contemplated and may obviously be resorted to by those skilled in the art without departing from the described invention, as hereinafter defined by the appended claims, as only a preferred embodiment thereof has been disclosed.

I claim:

1. An apparatus for brushing hose comprising support means, a sleeve journaled on said support means for rotation about its central longitudinal axis, a brush head assembly secured to said sleeve for rotation therewith, a plurality of circumferentially spaced brushes with radially disposed bristles journaled on said head assembly for rotation thereon and for rotation with said sleeve, drive means connected to said sleeve for rotating said sleeve about its axis, gear means journaled in said head assembly and operative upon rotation of said head assembly for rotating said brushes about their own axes while rotating with said brush head assembly, and said head assembly having adjusting means thereon for adjusting the radial position of said brushes relative to said central longitudinal axis.

2. An apparatus for brushing hose as set forth in claim 1 wherein said gear means includes a plurality of shafts journaled in said brush head assembly for rotation therein, said gear means includes gears mounted on said shafts for rotation therewith, a tubular member mounted within said sleeve and having a portion thereof secured to said support means, a spur gear keyed to one end of said tubular member operative to operate as a stationary sun gear; said gears meshing with said spur gear keyed to said tubular member for rotation with said sleeve, and said gears operative to rotate said brushes upon rotation of said sleeve.

3. An apparatus for brushing hose as set forth in claim 2 wherein said brush head assembly has a cage for rotating with said sleeve and for journaling said gear means, said brush head assembly has a pair of annular ring members circumferentially encompassing said cage said brush head assembly having a plurality of brackets pivotally mounted on said shafts, and one end of each of said brackets pivotally connected to said ring members for movement therewith to pivot said bracket relatively about said shaft to move said brushes radially inwardly or outwardly in accordance with the direction of pivotal movement of said ring members relative to said cage.

4. An apparatus for brushing hose as set forth in claim 3 wherein said adjusting means includes a threaded rod interconnecting said cage to said ring members, and rotation of said threaded rod moves and adjusts said ring members circumferentially relative to said cage to adjust said brushes radially relative to said central longitudinal axis.

5. An apparatus for brushing hose comprising support means, a sleeve journaled on said support means for rotation about a central longitudinal axis, drive means connected to said sleeve for rotating said sleeve, a tubular member mounted in said sleeve, one end of said tubular member secured to said support means, the other end of said tubular member having a spur gear keyed thereto, said sleeve having a cage in one end thereof for rotation therewith, journaled on said cage are a pair of ring members, rod members interconnecting said ring members for rotating said ring members simultaneously on said cage, a bracket means journaled on each of said rod members, a plurality of circumferentially spaced shafts journaled in said brackets and in said cage, each of said shafts having a gear keyed thereto and meshing with said spur gear for rotating said shafts upon rotation of said sleeve by said drive means, said cage having a plurality of arcuate slots, each of said brackets having another shaft journaled thereto which extends into one of said slots, a brush mounted on each of said other shafts for rotation therewith, intermeshing gear means mounted on said shafts for transmitting rotation from said gears keyed to said first mentioned shaft to said brushes, and adjusting means interconnecting said cage and said ring members to rotate said ring members relative to said cage for pivoting said brackets and brushes inwardly toward said central longitudinal axis or outwardly away from said central longitudinal axis.

6. An apparatus for brushing hose comprising a support means, a longitudinally extending sleeve mounted in said support means for rotation thereon, the one end of said sleeve having a pulley mounted thereon, drive means mounted on said support means and operatively connected to said pulley for rotating said sleeve, a cage mounted on the other end of said sleeve for rotation therewith, said cage having a pair of spaced annular side portions and a cylindrical surface, said sleeve having a centrally extending longitudinal pass line, a tubular member mounted in said sleeve having a centerline that is coincident with said pass line, one end of said tubular member secured to said support means and operative to support said sleeve for rotation thereon, said one end of said tubular member being adjacent to said one end of said sleeve, a spur gear secured to the other end of said tubular member defining a sun gear, a plurality of circumferentially spaced shafts having their ends journaled on said annular sides of said cage for rotation therein, each of said shafts spaced radially equidistant from said pass line, a pair of spur gears keyed to each of said shafts for rotation therewith and for rotation with said cage, one of said pair of spur gears meshing with said sun gear for rotation thereby upon rotation of said cage, a pair of annular ring members encompassing said cage, rod members journaled in said ring members interconnecting said annular ring members for simultaneous movement on said cage, adjusting means interconnecting said cage and said ring members for circumferentially adjusting said rings relative to said cage, a bracket journaled on each of said rod members, each of said brackets journaling one of said shafts that operates as a pivot means for each of said brackets, a plurality of circumferentially spaced shafts journaled in said brackets for movement therewith, said annular sides of said cage being slotted to permit radial movement of said last mentioned shafts as said brackets are pivotably adjusted, a spur gear secured to each of said last mentioned shafts for meshing engagement with the other one of said spur gears of said pair of spur gears to provide rotation to said last mentioned shafts upon rotation of said sleeve, and each of said last mentioned shafts supporting a brush with radially extending bristles for brushing a hose passing along said pass line.

* * * * *